US005129853A

United States Patent [19]

Bowling

[11] Patent Number: 5,129,853

[45] Date of Patent: Jul. 14, 1992

[54] ANIMAL TOY HAVING CHANGEABLE, CUTTABLE FUR

[75] Inventor: J. Michael Bowling, Springboro, Ohio

[73] Assignee: Mike Bowling Enterprises, Inc., Waynesville, Ohio

[21] Appl. No.: 684,007

[22] Filed: Apr. 11, 1991

[51] Int. Cl.[5] ..... A63H 3/02; A63H 3/44; A63H 13/02

[52] U.S. Cl. ..... 446/372; 446/394; 446/296

[58] Field of Search ..... 446/369, 370, 371, 372, 446/391, 394, 296, 3, 9, 901, 97, 98, 99, 100

[56] References Cited

U.S. PATENT DOCUMENTS

| | | | |
|---|---|---|---|
| 1,307,218 | 6/1919 | Spencer | 446/369 |
| 1,485,638 | 3/1924 | Smith | 446/369 |
| 1,552,348 | 9/1925 | Rosenthal | 446/99 |
| 1,630,165 | 5/1927 | Butler | 446/369 |
| 1,925,895 | 9/1933 | Biber | 446/370 |
| 2,274,303 | 2/1942 | Ornstein | 446/369 X |
| 3,808,736 | 5/1974 | Terzian et al. | 446/296 |
| 4,070,790 | 1/1978 | Strongin et al. | 446/394 |
| 4,208,832 | 6/1980 | Corriveau | 446/100 |
| 4,622,019 | 11/1986 | Katzman et al. | 446/153 |
| 4,648,851 | 3/1987 | Rosenberg | 446/372 |
| 4,695,264 | 9/1987 | McLeod, Jr. | 446/369 X |
| 4,874,345 | 10/1989 | Dirks | 446/394 |
| 4,921,461 | 5/1990 | Fujikawa | 446/296 |
| 4,979,924 | 12/1990 | Manger | 446/901 X |

FOREIGN PATENT DOCUMENTS

| | | | |
|---|---|---|---|
| 0104124 | 3/1984 | European Pat. Off. | 446/319 |
| 2537880 | 6/1984 | France | 446/319 |

*Primary Examiner*—Robert A. Hafer
*Assistant Examiner*—D. Neal Muir
*Attorney, Agent, or Firm*—Wood, Herron & Evans

[57] ABSTRACT

A pet animal toy has a body covered by a removable coat of long fur which can be cut and "groomed" to give a stylized appearance, then removed and replaced with another fur coat for cutting to give a different appearance. The coat covers substantially all the trunk of the body and the legs and appears to be fur grown on the animal. It may be secured by a concealed attachment under the body.

23 Claims, 1 Drawing Sheet

ANIMAL TOY HAVING CHANGEABLE, CUTTABLE FUR

FIELD OF THE INVENTION

This invention relates to playthings in the form of furry animals.

BACKGROUND

Children, particularly young girls, love to cut hair; grooming is said to have "high play value." Sometimes hair cutting is practiced on themselves or their friends, with disastrous results. Live pets such as dogs, and to a lesser extent cats, lambs, and other species which have long fur, are also groomed by cutting their fur in individualized and sometimes highly stylized shapes. French poodles are perhaps the most common example of this. The results of poor cutting with pets may have less negative impact than with children, but at best mistakes grow out again only slowly.

Sometimes dolls are "coiffed" but their haircuts do not ever grow out again.

THE PRIOR ART

Dolls with hair which can be cut and then made to "grow" again, either by putting on a replacement wig or by pulling strands from a supply inside the head, are known.

Toy animals which can be changed in appearance by adding or removing some part of the toy are known in the prior art. Spencer U.S. Pat. No. 1,307,218 discloses a doll with detachable, washable coverings. The cover is removable to clean it.

Rosenthal U.S. Pat. No. 1,552,348 discloses a convertible toy having a simulated fur covering, and can be changed from a baby doll to an animal by changing the removable head and pulling a fur covering over exposed skin areas of the doll.

Corriveau U.S. Pat. No. 4,208,832 discloses a convertible animal toy having different appendages and body parts which can be selectively attached to a head and body to form different creatures.

Dirks U.S. Pat. No. 4,874,345 shows a doll having a removable hairpiece which is attached by a suction cup onto the doll's head, for grooming different hair styles.

Manger U.S. Pat. No. 4,979,924 shows an animal body covered with a hook and pile type fastener. Press-on attachments such as nose and eye portions, ears, whiskers, cheeks, side coats, and tail, can be stuck on the body in various places to create fanciful appearances.

So far as I am aware, however, there has not heretofore been any animal toy having a fur covered body which, once trimmed, can be replaced or "regrown" so that it can be cut again to a different style.

SUMMARY OF INVENTION

In accordance with this invention a groomable furry animal toy is provided, having a body with a head, trunk and legs which simulates a pet animal. The head and/or paws may have "permanent" (non-replaceable) fur, but long, cuttable (groomable) fur is not provided on the trunk of the body. A removable "fur coat" is fittable over the trunk of the body, having long, cuttable simulated fur which, when the coat is in place on the body, realistically appears to have grown on the animal itself. The fur of the coat can be cut as if the animal were being groomed, and the coat can thereafter be removed and replaced by another coat which can then be cut to give a different appearance. Thus a given animal toy can be made to resemble different breeds, or different pets, or the same animal can be given different styles.

DESCRIPTION OF THE DRAWINGS

The invention can best be further described by reference to the accompanying drawings, in which.

DETAILED DESCRIPTION

Figure 1:
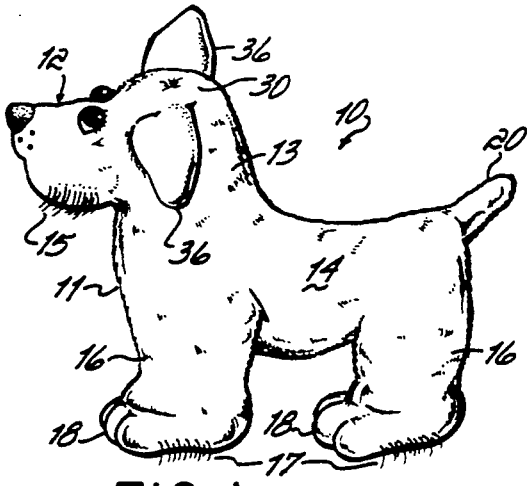
FIG. 1 is a side view of one form of animal toy in accordance with the invention, showing the body without the fur coat.

For purposes of explanation, the drawings show a fanciful dog toy 10, approximately resembling a Shih-tzu breed of dog. It should be understood, however, that the invention can be embodied in other breeds of dogs, and/or cats, lambs and other long furred animals. The animal 10 has a body 11 with a head 12, neck 13, a trunk or main body portion 14, four legs 16 with paws 18, and a tail 20. The animal 10 is preferably a soft sculpture, that is, a cloth "skin" stuffed with synthetic fiber. The body shown has a skin of plush with short pile (e.g., ¼"), which is too short for cutting. The animal may have permanently attached simulated fur on the head, as designated by 15 in FIG. 1, and/or on the paws as at 17, and on the tail, but does not on the trunk of the body. Alternatively, the body may be molded (hollow) vinyl, or it may even be solid.

Any permanent fur on the animal can be applied by stitching, in the manner in which hair is stitched into the heads of dolls. As will be seen, any permanent fur on the body is not replaceable if cut, whereas the fur coat can be replaced or "regrown."

A removable fur coat 22 (shown separately in FIG. 2), fits completely over at least the trunk 14 of the animal. Coat 22 preferably comprises long pile plush having a backing 24 and groomable hair 26 simulating animal fur. The backing may be stretchable so that the coat fits snugly over the trunk 14; alternatively, the coat may be somewhat loose to give the appearance of floppy skin, such as a St. Bernard or bulldog has. The fur may be of synthetic material such as nylon, of a type which can easily be cut by a child with a child's scissors. Long fur (for example 1½ to 2 inches long) is preferred as it gives the most dramatic results when cut. Coats for a given body may have different types and coloration of hair: curly, straight, spotted, styled, braided, waffled, and so on. Thus, depending on the coat, a given body may be made to look like a lhasa apso dog (which has long straight hair) or a poodle with fluffy hair.

The coat 22 covers essentially the entire trunk 14, like a sweater, and preferably has integral "sleeves" 27 through which the four legs 16 extend. The coat may also include a hood 28 which fits over the neck 13 and top part 30 of the head of the animal, so that head fur can also be groomed. The hood 28 has openings 29 through which the ears 36 protrude. The coat preferably does not cover the face, the paws, and tail, if any.

Figure 2:
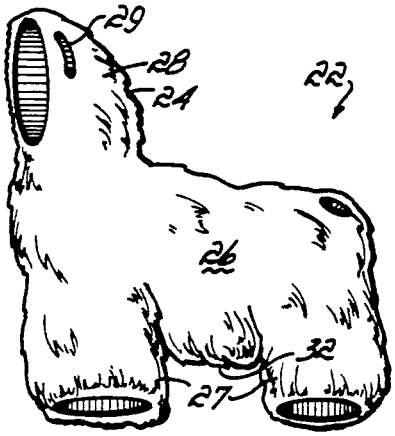
FIG. 2 is a side view of one form of fur coat shaped to fit on the body of the toy shown in FIG. 1.
Figure 3:
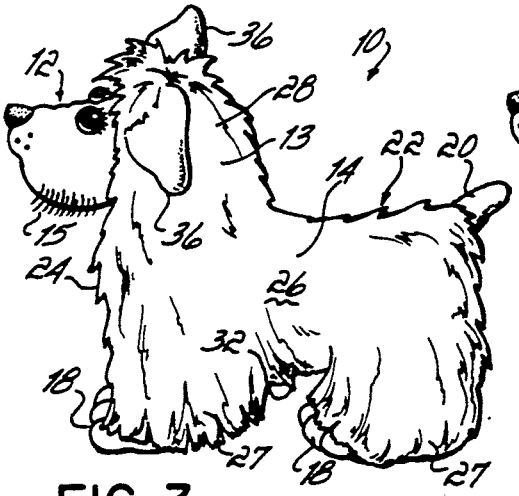
FIG. 3 shows the animal toy of FIG. 1 wearing the fur coat of FIG. 2.
Figure 5:
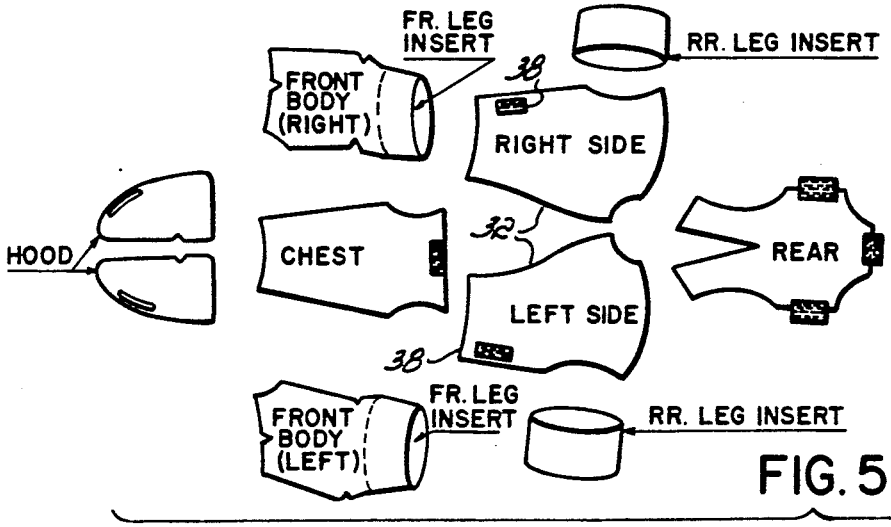
FIG. 5 is a plan view of the preferred pattern for the particular coat of FIG. 2.

The coat preferably opens beneath the trunk as at 32 for removal (see FIGS. 2 and 5). It can be secured like a vest, as by strips 38 of Velcro brand fasteners, but other attaching means, including but not limited to buttons, snaps, and elastics, may alternatively be used.

Figure 4:
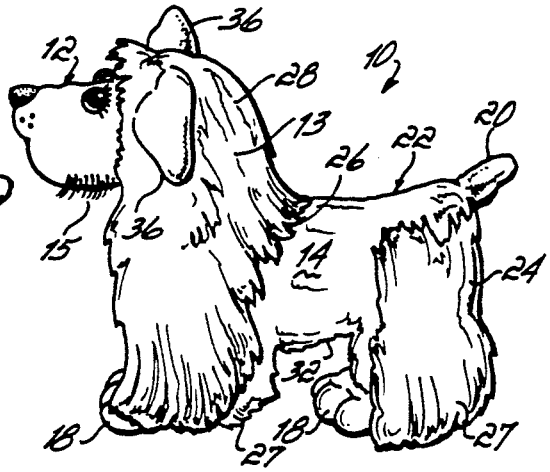
FIG. 4 shows the toy of FIG. 3 after the coat has been cut and groomed.

FIG. 4 illustrates one of the almost infinite types of fanciful styling which can be done to the toy. By way of example, the fur of the coat is shown closely shorn or clipped around the middle of the trunk and on the front of the rear legs. Other stylings may be anything from irregular hacking to very formal clipping, as with a French poodle. Whatever the results, satisfactory or unsatisfactory, they can be reworked until there is little more hair to cut on the coat; and the results can be changed by starting out afresh with another fur coat on the body. The same toy can thus be groomed to give different appearances of the same animal, or different breeds, or even a different animal.

FIG. 5 is an example of a pattern for the parts to form the particular coat shown in FIG. 2. The pieces are cut separately and sewn together leaving spaces for the head, ears, tail, and paws, to project through the coat. The fur preferably extends right to the edges of the coat so as more realistically to give the impression that the coat is really fur which has grown on the body, rather than a separate garment.

Having described the invention, what is claimed is:

1. An animal toy and a plurality of changeable, cuttable body fur coats for said toy, said toy comprising a body simulating a pet, said body having a head, trunk, and legs, and each said coat comprising a unitary, removable fur coat which extends around and covers at least said trunk of said body, each said coat comprising a backing and cuttable fur on the backing, the fur of each said coat being sufficiently long to be cuttable as if said pet were being clipped, each said coat simulating fur that has grown on said pet rather than a separate garment, a first said coat being removable form said body after the fur thereon has been cut and replaceable by another said coat the fur of which can be cut to give a different appearance than said first coat.

2. The toy of claim 1 wherein at least one said coat also covers said legs but not said head.

3. The toy of claim 1 wherein at least one said coat includes sleeves through which said legs fit.

4. The toy of claim 1 wherein at least one said coat includes an integral furry hood which is fittable cover a part of said head.

5. The toy of claim 1 wherein said fur extends to and covers margins of at least one said coat.

6. The toy of claim 1 further including simulated hair on said head but not on the trunk of said body.

7. The toy of claim 1 further including paws having simulated hair on them.

8. The toy of claim 1 wherein said body is a soft sculpture.

9. The toy of claim 1 wherein said body is molded vinyl.

10. The toy of claim 1 further including means, for removably securing a said coat on said body.

11. The toy of claim 10 wherein said securing means are concealed by a said coat.

12. The toy of claim 11 wherein said securing means are hook and pile type fasteners.

13. The toy of claim 10 wherein a said coat closes like a vest, said securing means are positioned under said body.

14. The toy of claim 1 wherein said backing is stretchable.

15. The toy of claim 1 wherein a said coat fits snugly around said body.

16. The toy of claim 1 wherein at least one said fur coat is a sweater which fits over the legs and encircles the torso of the body.

17. The toy of claim 1 wherein at least one said coat is stretchable over said trunk and at least two of said legs.

18. The toy of claim 1 wherein said trunk is without cuttable fur.

19. The toy of claim 1 wherein said body is without means for fastening said coat to it.

20. A method of providing differently clipped appearances for a furry animal toy comprising, providing an animal toy simulating a pet, said toy having a body with a trunk, providing a plurality of separate, removable fur coats for said toy, each said coat being shaped to cover at least the trunk of said toy and having cuttable fur simulating fur which has grown on said trunk, putting a first one of said coats on said toy, clipping fur on said first coat to groom it, removing said first coat and replacing it with a second such coat, and clipping said second coat to give another appearance.

21. The method of claim 20 wherein said animal toy has legs and at least one said coat has furred sleeves fittable over said legs, and including the further steps of covering said legs with said sleeves and cutting fur on said sleeves.

22. The method of claim 20 wherein said toy has at least two legs and said coat is fitted over said legs and around said trunk.

23. The method of claim 22 wherein said coat is stretched to fit around said legs.

* * * * *